US008556200B2

(12) United States Patent
Piotrowski et al.

(10) Patent No.: US 8,556,200 B2
(45) Date of Patent: Oct. 15, 2013

(54) SYSTEM, METHOD AND APPARATUS FOR PROCESSING FIBER MATERIALS

(75) Inventors: Tony S. Piotrowski, Winter Haven, FL (US); Jack D. Coulter, Winter Haven, FL (US); Bruce A. Hartzell, Mickleton, NJ (US)

(73) Assignee: Certainteed Corporation, Valley Forge, PA (US)

( * ) Notice: Subject to any disclaimer, the term of this patent is extended or adjusted under 35 U.S.C. 154(b) by 454 days.

(21) Appl. No.: 12/981,657

(22) Filed: Dec. 30, 2010

(65) Prior Publication Data

US 2011/0198426 A1 Aug. 18, 2011

Related U.S. Application Data

(60) Provisional application No. 61/304,543, filed on Feb. 15, 2010.

(51) Int. Cl.
*B02C 19/22* (2006.01)

(52) U.S. Cl.
USPC ..... 241/60; 241/260.1

(58) Field of Classification Search
USPC ..... 241/260.1, 60, 605
See application file for complete search history.

(56) References Cited

U.S. PATENT DOCUMENTS 3,254,777 A * 6/1966 Vandusen ..... 414/320
4,337,902 A 7/1982 Markham
4,465,239 A 8/1984 Woten
5,462,238 A 10/1995 Smith et al.
6,088,968 A 7/2000 Williston, Jr. et al.
6,668,534 B2 12/2003 Sheedy et al.
6,732,960 B2 5/2004 Shaw et al.
6,796,748 B1 9/2004 Sperber
7,207,506 B1 * 4/2007 Dickson et al. ..... 241/21

OTHER PUBLICATIONS

Martin Sprocket & Gear, Inc., Catalog 2001, CEMA Standards, 2 pages.

* cited by examiner

*Primary Examiner* — Mark Rosenbaum
(74) *Attorney, Agent, or Firm* — Abel Law Group, LLP; Alexander H. Plache

(57) ABSTRACT

A system for processing material has a power supply and a machine having a hopper for receiving and passing material to an auger. The auger has a shaft with an axis about which it rotates, a helical flighting mounted to the shaft, pins mounted to the helical flighting, and paddles mounted to the shaft. The radial outer edge of the helical flighting is crenelated with periodic notches that form rectangular blades on the helical flighting. The pins are rotationally and angularly aligned with leading edges of the rectangular blades. The system may include a vehicle, such as a trailer, having first and second compartments separated by a partition. The power supply is located in the first compartment and has a power supply member extending though the partition. The machine is located in the second compartment and coupled to the power supply member.

26 Claims, 12 Drawing Sheets

SYSTEM, METHOD AND APPARATUS FOR PROCESSING FIBER MATERIALS

This application claims priority to and the benefit of U.S. Prov. Pat. App. No. 61/304,543, filed Feb. 15, 2010, which is incorporated herein by reference in its entirety.

BACKGROUND

1. Field of the Disclosure

This invention relates generally to providing insulation materials for application to and installation in buildings or other structures and, in particular, to an improved system, method and apparatus for the economical and efficient application of particulate insulation materials from bales or bags of insulation to the surfaces of buildings or other structures by processing and pneumatically blowing or spraying such materials.

2. Description of the Related Art

Insulation materials such as fibers of granulated rock wool, granulated mineral fiber wool, glass fiber materials, cellulose fibers, expanded mica, etc., may comprise a particulate form. They are typically either blown dry or sprayed through a nozzle with a liquid to form an insulating and sealing coating on a surface. These materials are blown on conventional walls, attics and ceilings in places of habitation or working areas, but also may be sprayed on any other surface as desired.

The insulation material used in conventional insulation spraying and blowing machines is usually in a relatively loose condition. However, it is packed under high compression in bales, bags or sacks for shipment to the user. Upon being opened, the bales or bags are typically manually placed into the receiving hopper of the insulation spraying and blowing machine. The compressed masses of insulation material normally would render the insulation material difficult to use in a conventional apparatus that requires feeding through an air hose to a dispensing nozzle. To reduce the masses of insulation, which may include nodules of material, separation into particulate form must be performed. To some extent the insulation material may be entwined rather than discreet in form. The particulate may include not only particles but also intertwined or overlapping fibers.

To apply insulation materials not only in particulate form but also economically and efficiently, the desirable insulation blowing apparatus would be on a wheeled vehicle for convenience and economy of application. This necessitates a near continuous supply of insulation filled bags with the insulation being emptied into the hopper of the insulation blowing machine.

Accordingly, some commercial hoppers are quite large and operate to fill machines with a series of material separation and movement devices for sequentially chopping, mixing and churning the material, which significantly increases the overall size and complexity of the machine. In contrast, small volume machines have hoppers with minimal capacity and require continuous attention. Small machines also require the insulation to be broken up into smaller pieces for introduction into the feeding hoppers. Moreover, all small machines are electric and do not have their own power supply, with many requiring a dual electric circuit to provide power to their chopper and blower. An improved design for processing and distributing insulation would be desirable.

SUMMARY OF THE INVENTION

Embodiments of a system, method and apparatus for processing material are disclosed. For example, an embodiment of an apparatus for processing material comprises a power supply and a machine powered by the power supply and having a hopper for receiving and passing material to an auger. The auger has a shaft with an axis about which it rotates, a helical flighting mounted to the shaft, pins mounted to the helical flighting, and paddles mounted to the shaft.

In some embodiments, the radial outer edge of the helical flighting is crenelated with periodic notches that form rectangular blades on the helical flighting. The pins are rotationally and angularly aligned with leading edges of the rectangular blades, and extend radially beyond the helical flighting. The axial end of the helical flighting forms a distal edge that may be rotationally aligned with at least one of the paddles.

Embodiments also comprise a system for processing insulation material, including a vehicle, such as a trailer, having first and second compartments separated by a partition. The power supply is located in the first compartment and has a power supply member extending though the partition. The machine is located in the second compartment and coupled to the power supply member.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DETAILED DESCRIPTION

Figure 1:
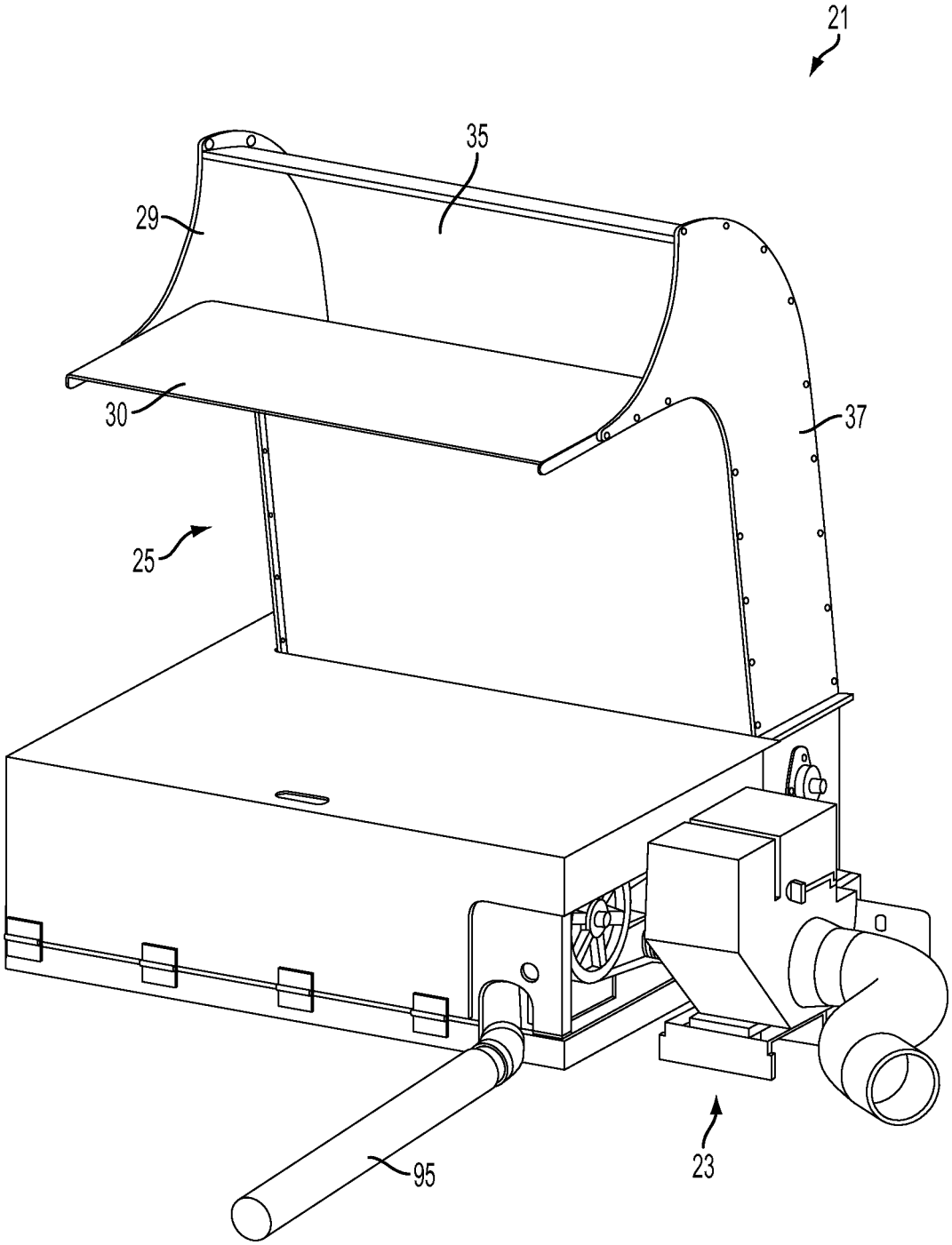
FIG. 1 is a front isometric view of one embodiment of an insulation processing apparatus.
Figure 2:
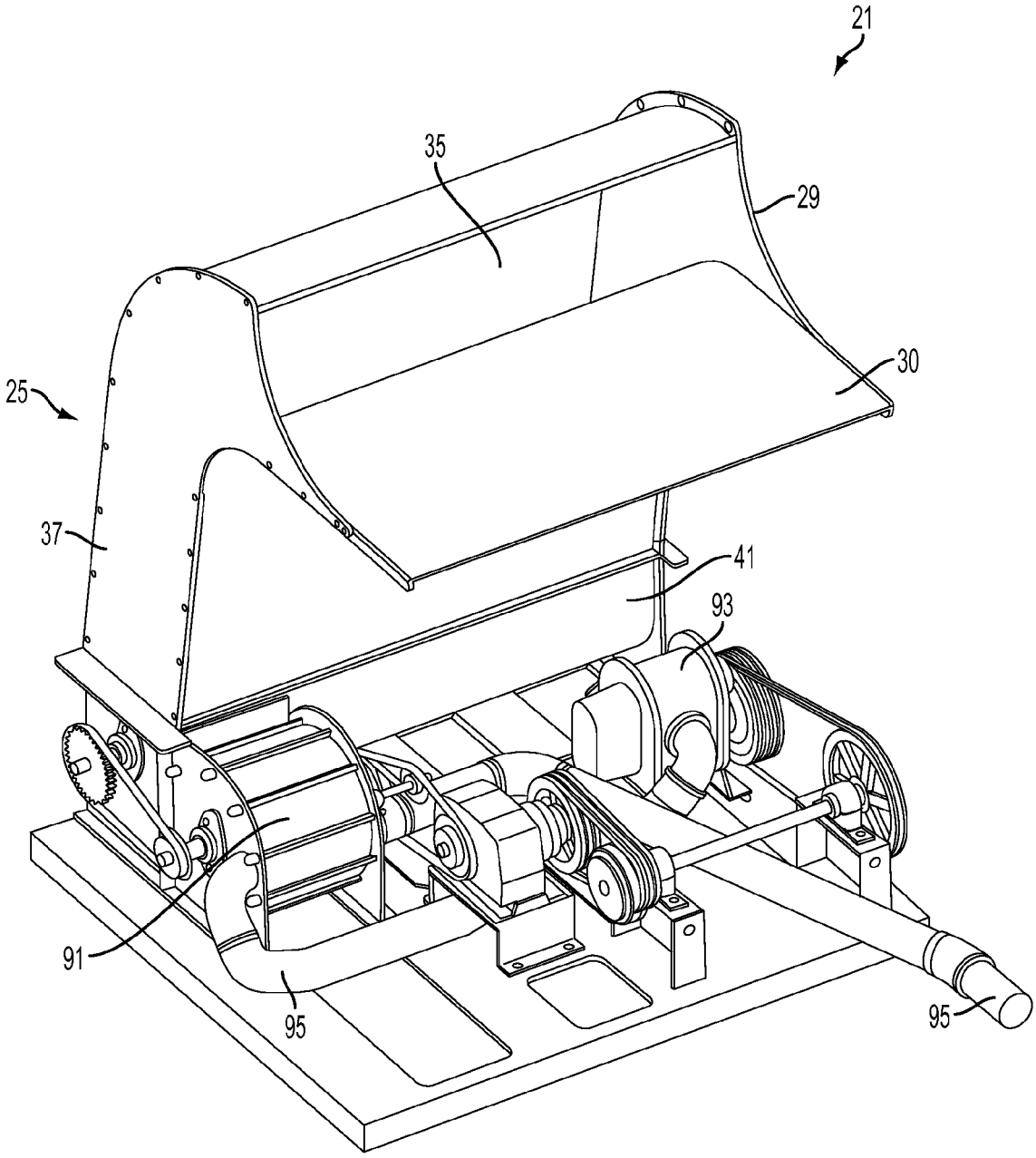
FIG. 2 is another isometric view of a portion of another embodiment of the apparatus, shown with a cover removed.
Figure 3:
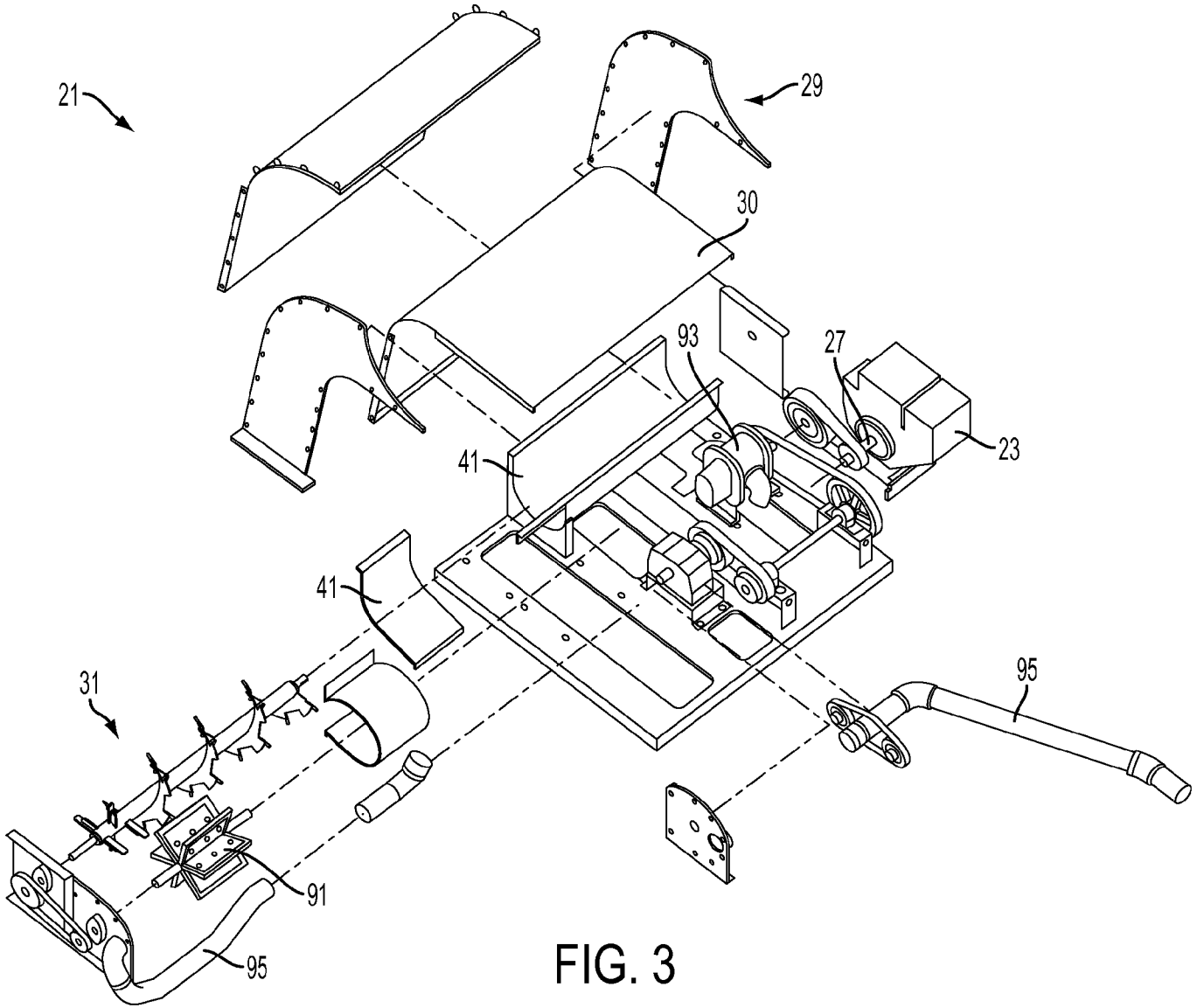
FIG. 3 is an exploded isometric view of another embodiment of the apparatus.

FIGS. 1-12 disclose embodiments of a system, method and apparatus for processing material. For example, as shown in FIGS. 1-3, the apparatus 21 may comprise a power supply 23 and a machine 25 that is coupled to and powered by the power supply 23 for processing insulation materials. In the embodiment shown, the power supply 23 comprises an internal combustion engine that is coupled to the machine 25 via a drive shaft 27 (FIG. 3). In other embodiments, however, the power supply 23 may comprise other types of mechanical or electrical power generators. The power supply 23 may be coupled to the machine 25 via various means such as the pulleys, belts, shafts and gears depicted, as is known to those of ordinary skill in the art.

The machine 25 has a hopper 29 for receiving and passing material to an auger 31 (FIG. 3) that rotates within the machine 25. The hopper 29 may be provided with a horizontal platform 30 for supporting a bale, sack or bag of material 33 (see, e.g., FIG. 9). In the embodiment shown, the hopper 29 has a capacity of approximately 1.5 bales and passes the material directly to the auger 31 by gravity. The hopper 29 has a generally rectangular opening 35 (FIG. 1) that is configured to and slightly larger than the profile of the bale 33 of material to limit the intake of material. The horizontal platform 30 transitions to a substantially vertical chute 37 downstream from the opening 35. The vertical chute 37 is located directly over a portion of the auger 31.

Figure 4:
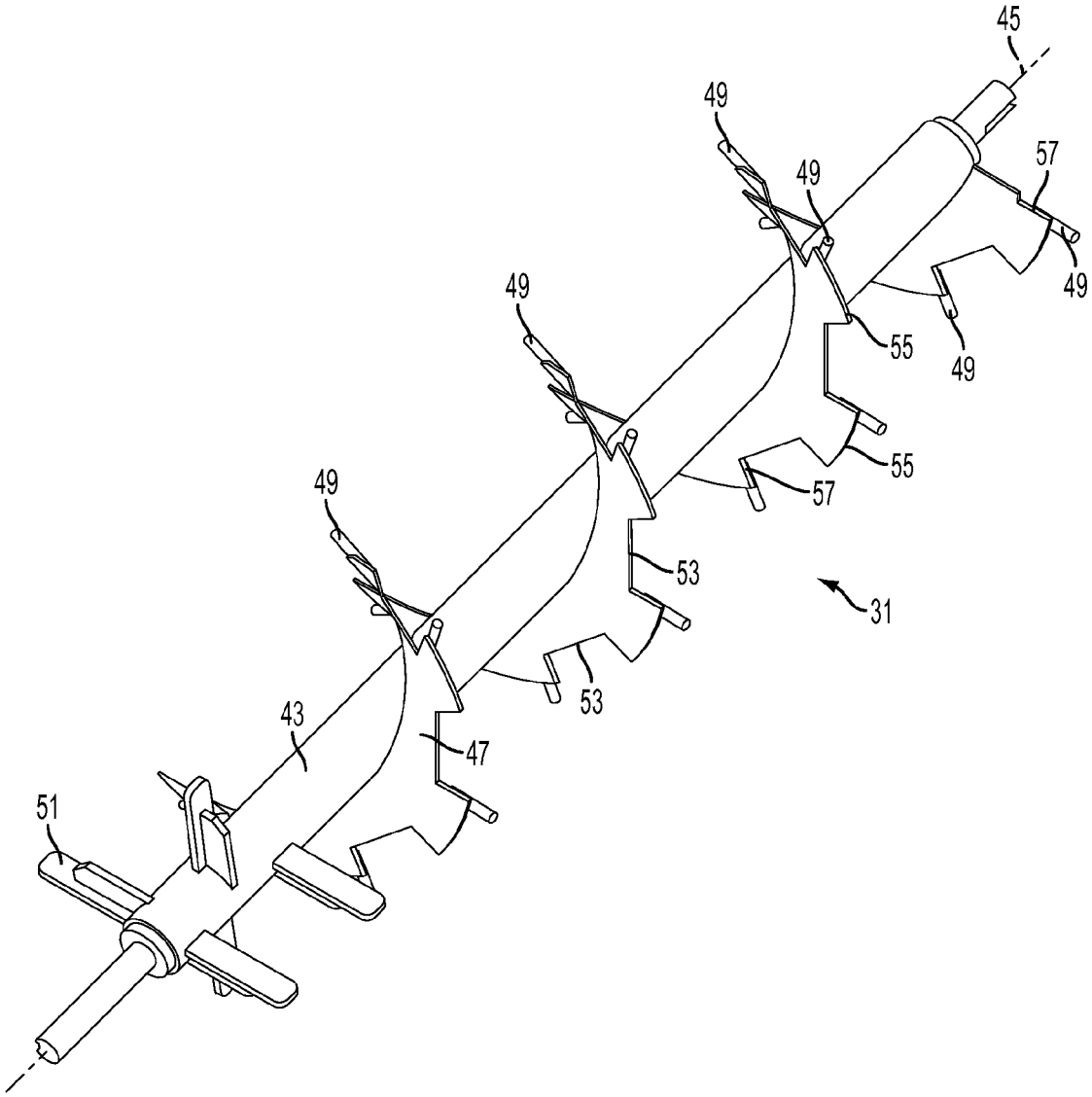
FIG. 4 is an isometric view of an embodiment of an auger for the apparatus.
Figure 5:
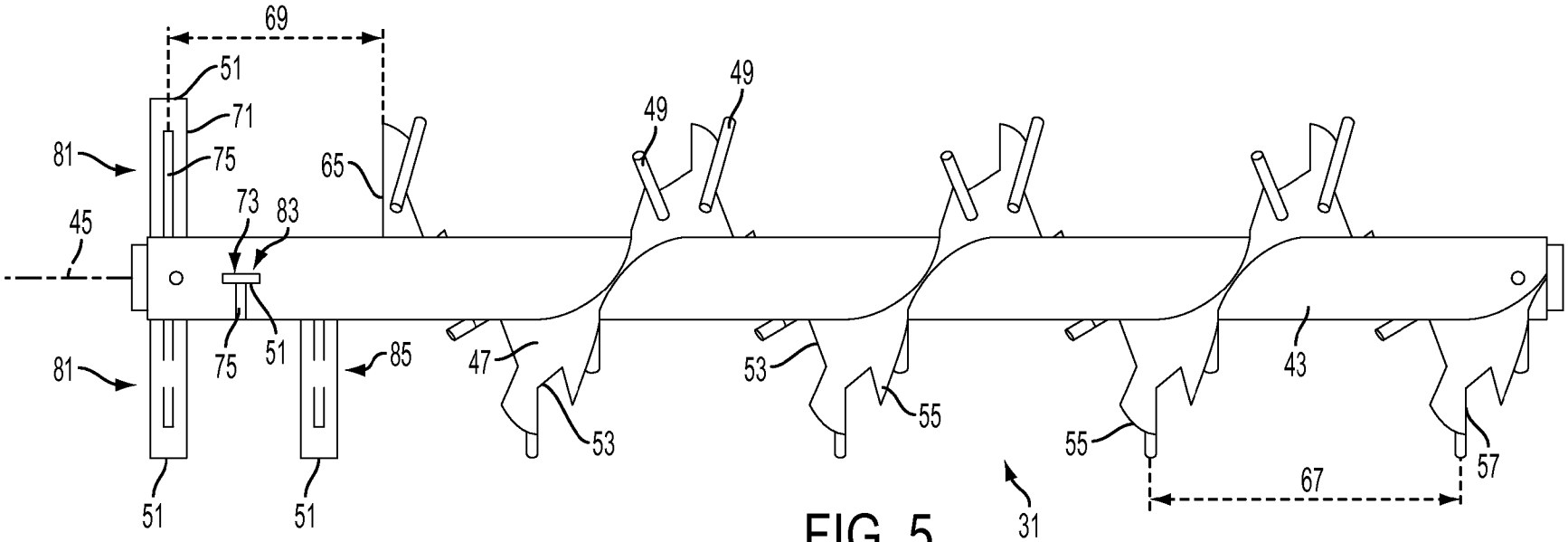
FIG. 5 is a side view of an embodiment of an auger.
Figure 6:
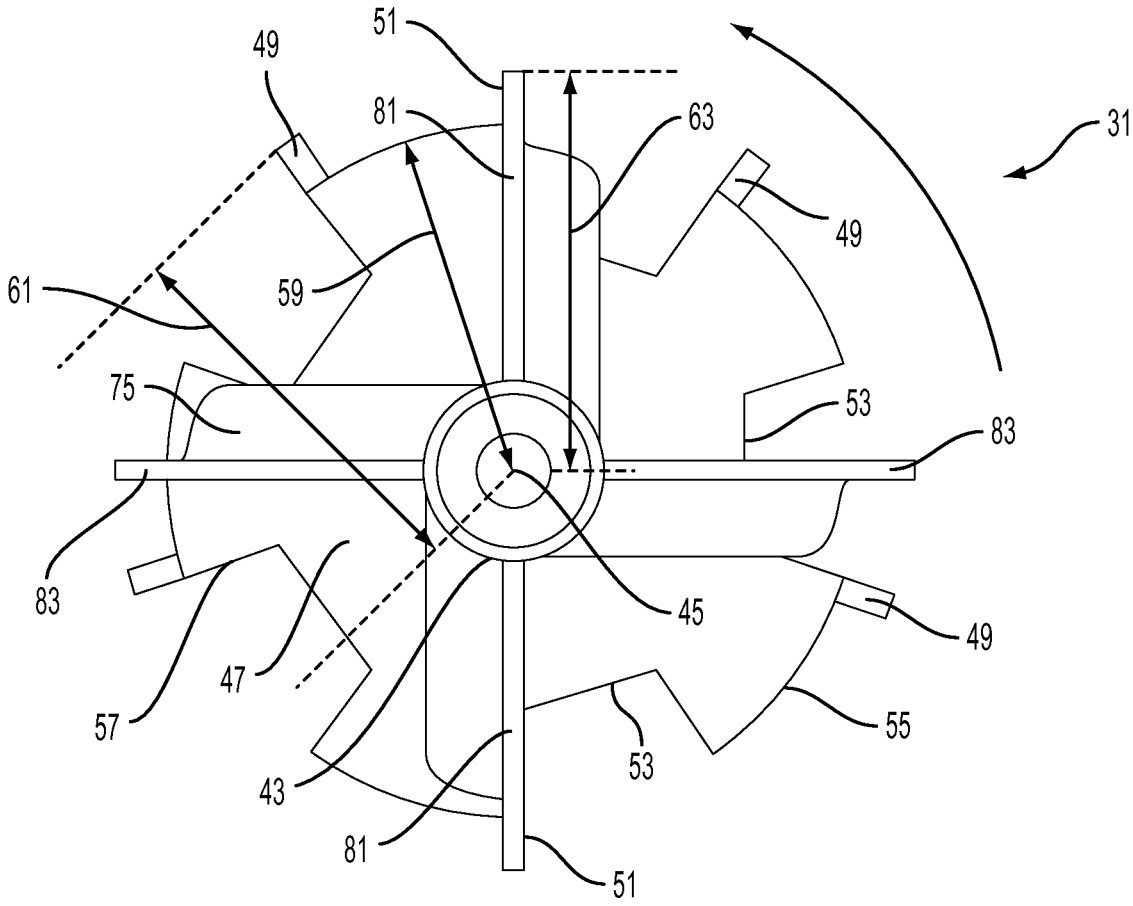
FIG. 6 is an end view of an embodiment of an auger.

In the illustrated embodiment, the auger 31 is located in a trough 41 (FIGS. 2 and 3) and coupled to and rotated by the power supply 23 without contacting the surfaces of the trough 41. As best shown in FIGS. 4-6, the auger 31 comprises a shaft 43 with an axis 45 about which the auger 31 rotates. In the embodiment shown, a single spiral or helical flighting 47 (e.g., a helix) is mounted to the shaft. Pins 49 are mounted to the helical flighting 47, and a series of paddles 51 are mounted to the shaft 43.

The embodiment shown depicts a radial outer edge of the helical flighting 47 being crenelated or castellated with periodic notches 53 that form generally rectangular blades 55 on the helical flighting 47. The pins 49 are rotationally and angularly aligned with the leading edges 57 of the generally rectangular blades 55. The pins 49 extend radially beyond the radial outer edge of the helical flighting, such that the radial outer edge has a shorter radial length 59 (FIG. 6) than a pin radial length 61 of pins 49 relative to the axis 45. The pins 49 have distal ends that define the pin radial length 61 relative to the axis 45. The paddles 51 have distal ends that define a paddle radial length 63 relative to the axis 45, and the pin and paddle radial lengths 61, 63 are equal in some embodiments.

Embodiments of an axial end 65 (FIG. 5) of the helical flighting 47 form a distal edge thereof that is rotationally aligned (e.g., at the 12 o'clock position in FIG. 6) with at least one of the paddles 51 (e.g., one paddle 51 in the embodiment shown). The distal edge 65 extends in a radially orthogonal direction relative to the axis 45. In addition, the helical flighting 47 has an axial pitch 67 (FIG. 5) that is cyclical and defines an axial length. The distal edge 65 of the helical flighting 47 is spaced apart from the one aligned paddle 51 by an axial distance 69 that is less than the axial pitch 67. In some embodiments, the helical flighting 47 has at least three axial pitches.

Again referring to the embodiment of FIG. 5, each paddle 51 comprises a plate 71 with a surface 73 that is flat, elongated and rectangular. Each plate 71 protrudes radially from the shaft 43 such that the surface 73 is parallel to the axis 45. Each plate 71 also is supported by a support bracket 75 extending from the shaft 43.

In some embodiments, the paddles 51 comprise a first set 81 (FIGS. 5 and 6) of two paddles 51 at an axial end of the shaft 43. The first set 81 is rotationally opposed (e.g., at the 12 and 6 o'clock positions) to each other relative to the axis 43. A second set 83 of two paddles 51 are axially spaced apart from and rotationally orthogonal to the first set 81. The second set 83 also is rotationally opposed to each other at, for example, the 3 and 9 o'clock positions. A single paddle 85 is axially spaced apart from and rotationally orthogonal to the second set 83 and axially opposite the first set 81. The single paddle 85 rotationally aligns with one of the two paddles 51 of the first set 81 (e.g., at the 6 o'clock position).

In operation (FIG. 9), the bale 33 is opened and any packaging material or binding for the material is discarded. The material is put in hopper 25 and moved by the operator from the platform through opening 35 and falls through vertical chute 37 onto the rotating auger 31. The whirling helical flighting 47 and pins 49 pick apart the insulation material and axially propagate or push it right to left (in the illustrated embodiment) toward paddles 51. Thus, only some of the insulation material entering through the hopper 25 makes immediate contact with paddles 51. Paddles 51 then push the separated material away from the auger 31 out of the trough 41 and into a feeder 91 (FIGS. 2 and 3) having an airlock for maintaining pneumatic pressure in the system. A blower 93 provides air pressure to feeder 91 and propels the separated material through hoses 95 for delivery to and installation in a building or the like, as is known by those of ordinary skill in the art.

Figure 7:
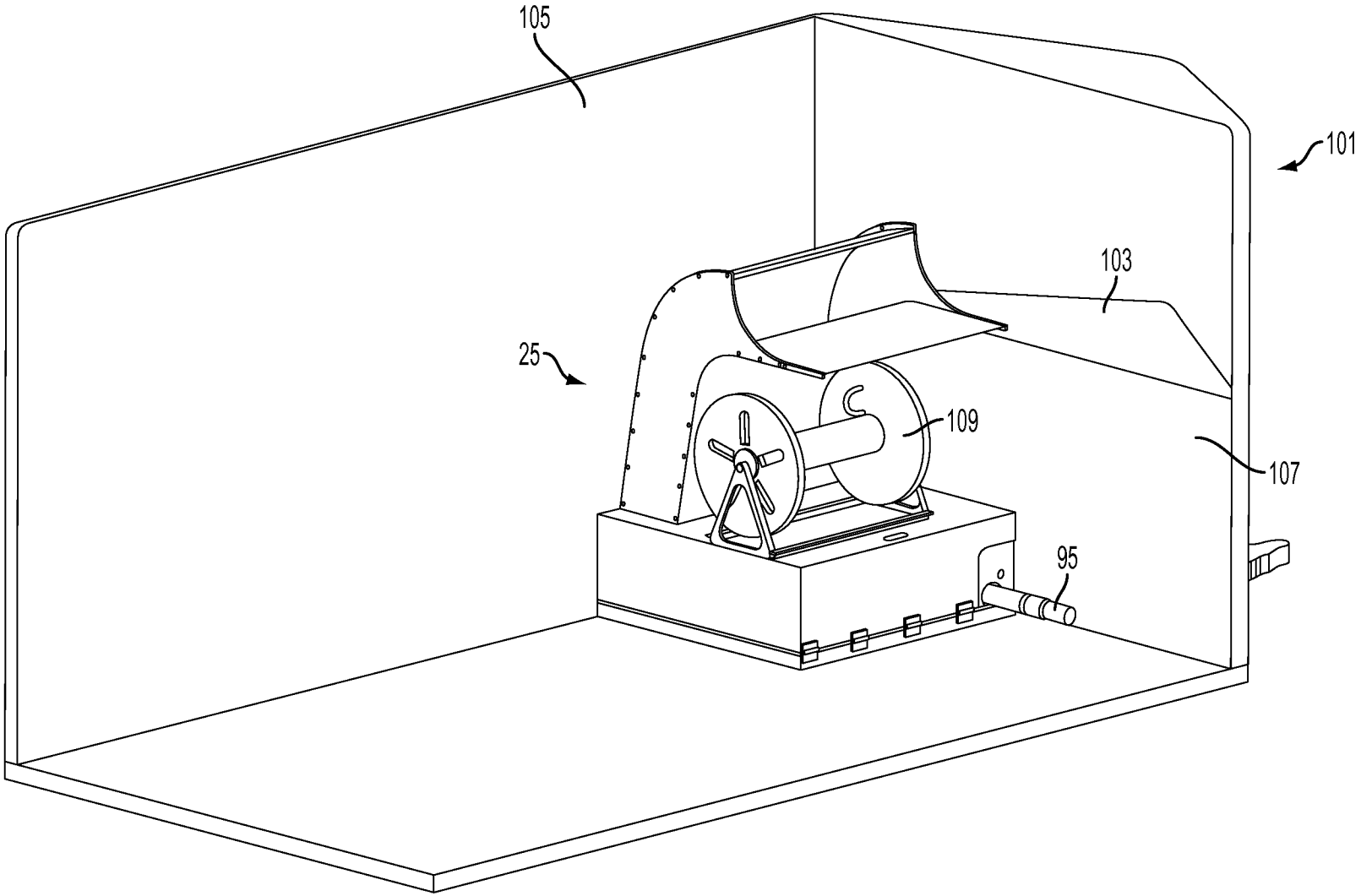
FIG. 7 is an isometric view of another embodiment of the apparatus, shown installed in a trailer (with some walls removed for illustration purposes)
Figure 8:
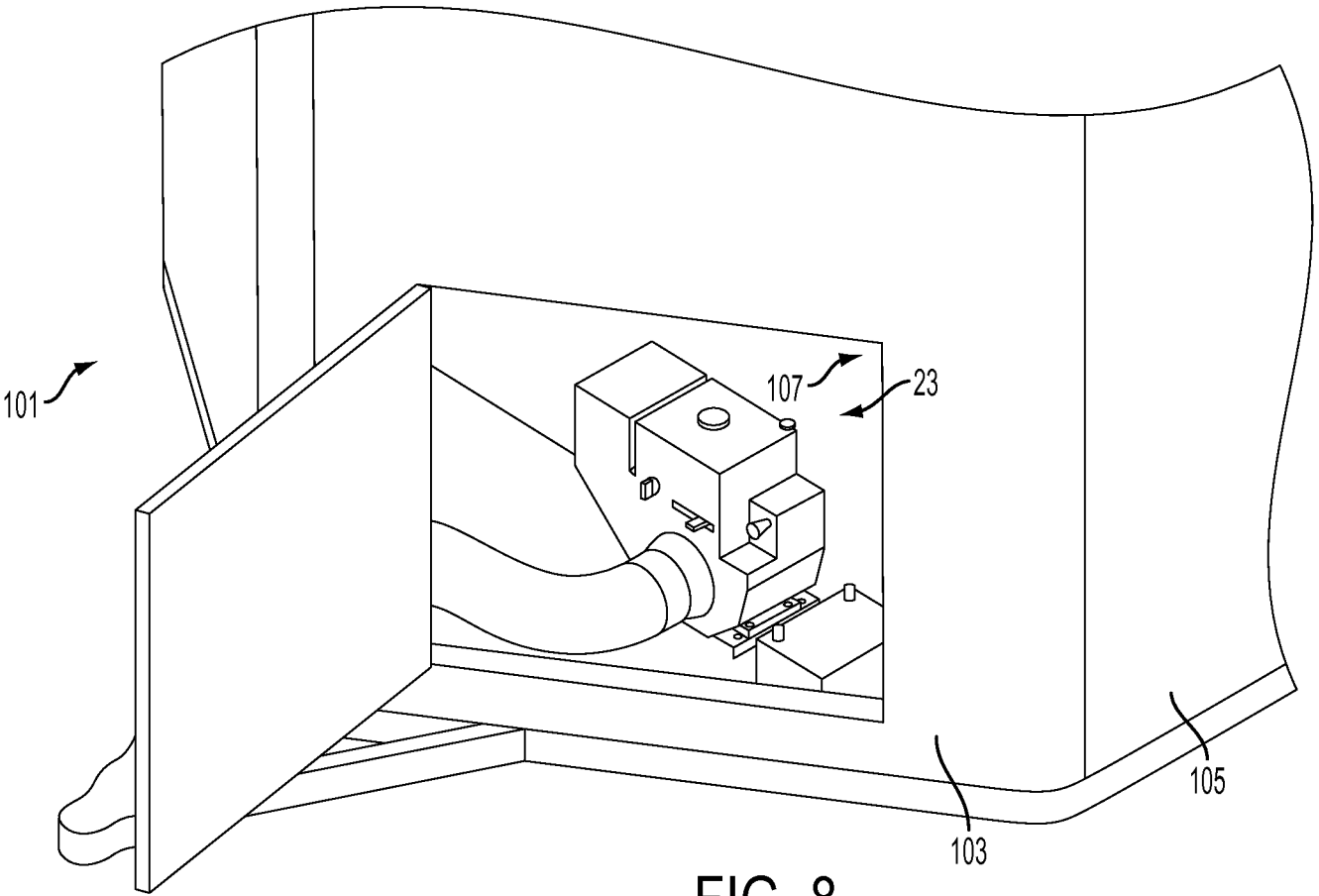
FIG. 8 is a front isometric view of an embodiment of a power supply for the apparatus installed in a compartment of a trailer.
Figure 9:
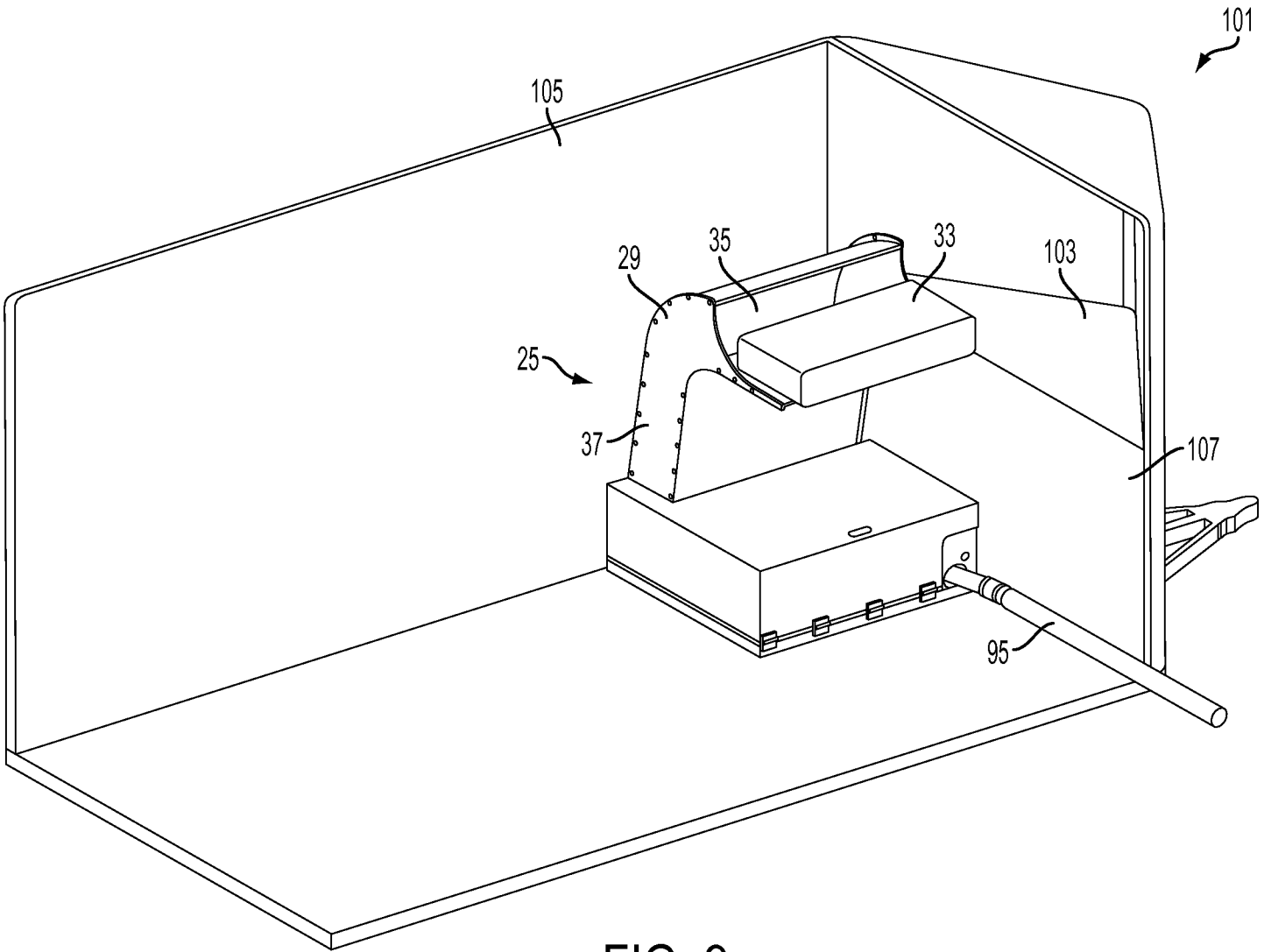
FIG. 9 is an isometric view of another embodiment of the apparatus, shown installed in a trailer and with a bale of insulation material.

Referring now to FIGS. 7-9, some embodiments comprise a system for processing insulation material. For ease of transportation, a vehicle 101 (e.g., a utility tow trailer, or mid-size box truck or van), has first and second compartments 103, 105 separated by a partition 107. The power supply 23 is located in the first compartment 103 and has a power supply member (e.g., drive shaft) extending though the partition. In other embodiments, only the drive shaft extends through the partition 107, which is sealed to avoid exposing the operator in compartment 105 to the noise, heat and fumes generated by the power supply 23.

The machine 25 may be located in the second compartment 105, coupled to the power supply member and operates as described herein. In FIG. 7, the machine 25 has an optional spool 109 for coiling the hose 95. In some embodiments, the first and second compartments 103, 105 are completely separated interior compartments within the vehicle or trailer 101. The partition 107 may comprise a solid insulated wall that completely separates and isolates the first and second interior compartments 103, 105.

Figure 10:
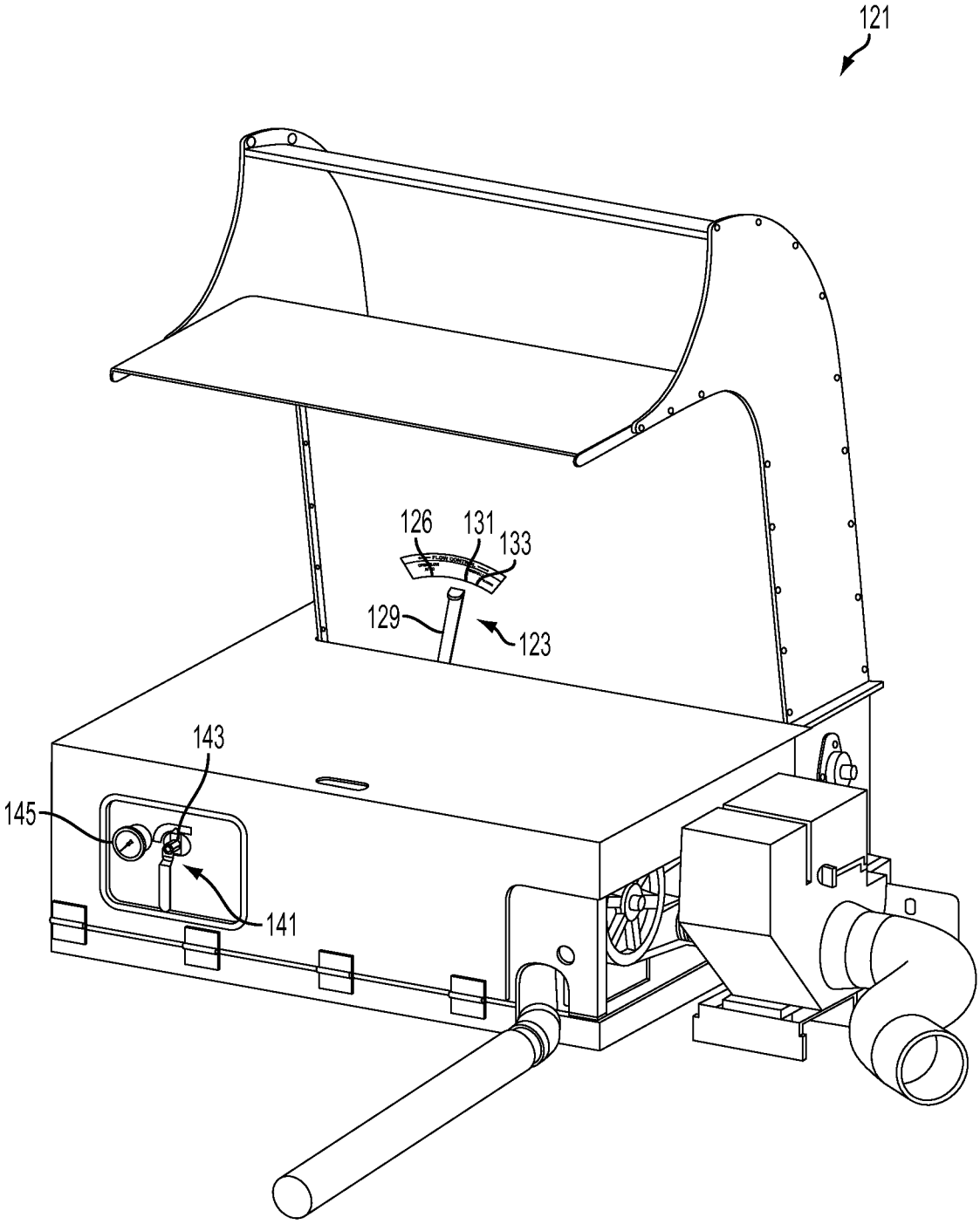
FIG. 10 is an isometric view of an alternate embodiment of the apparatus.
Figure 11:
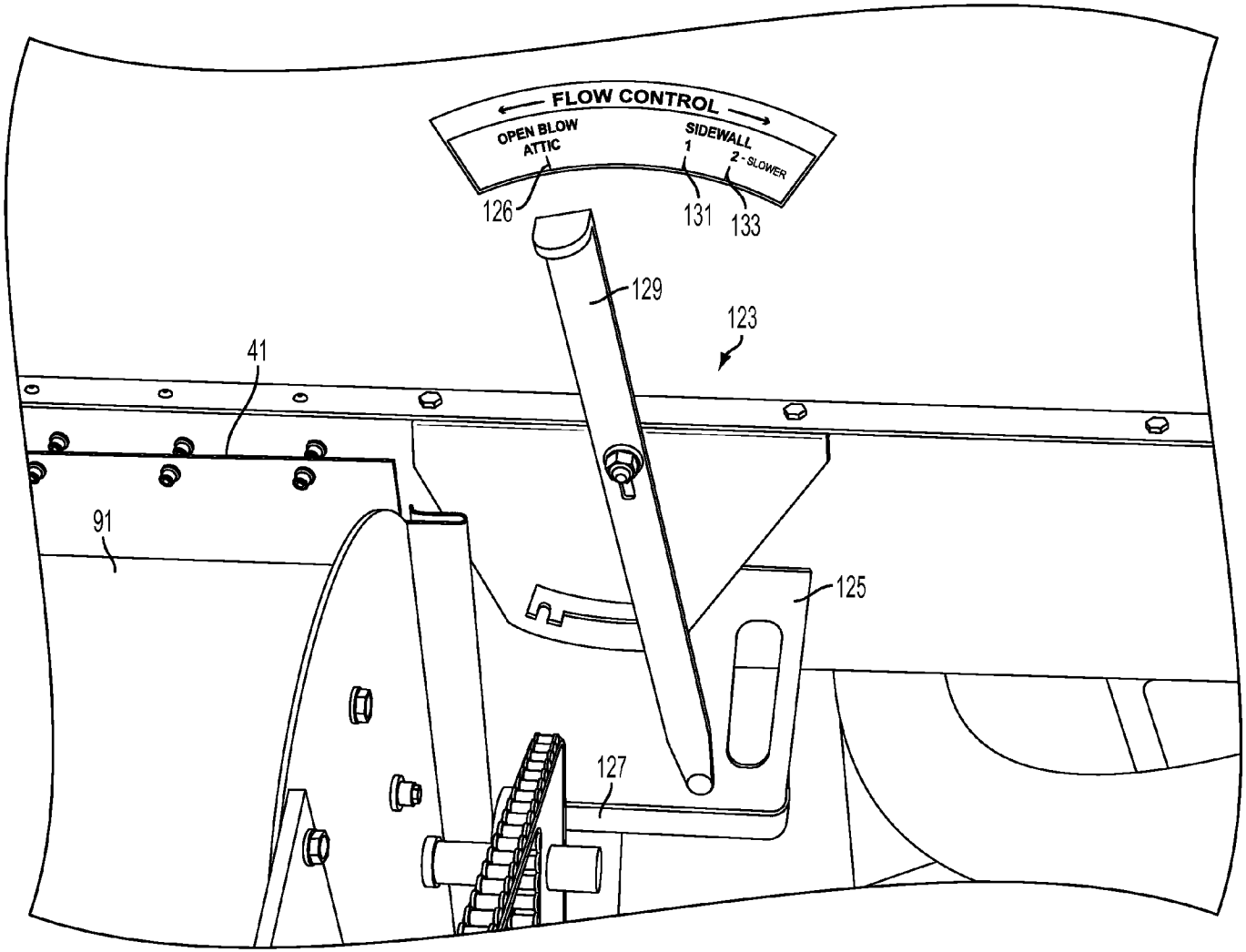
FIGS. 11 and 12 are enlarged front views of different portions of the apparatus of FIG. 10.
Figure 12:
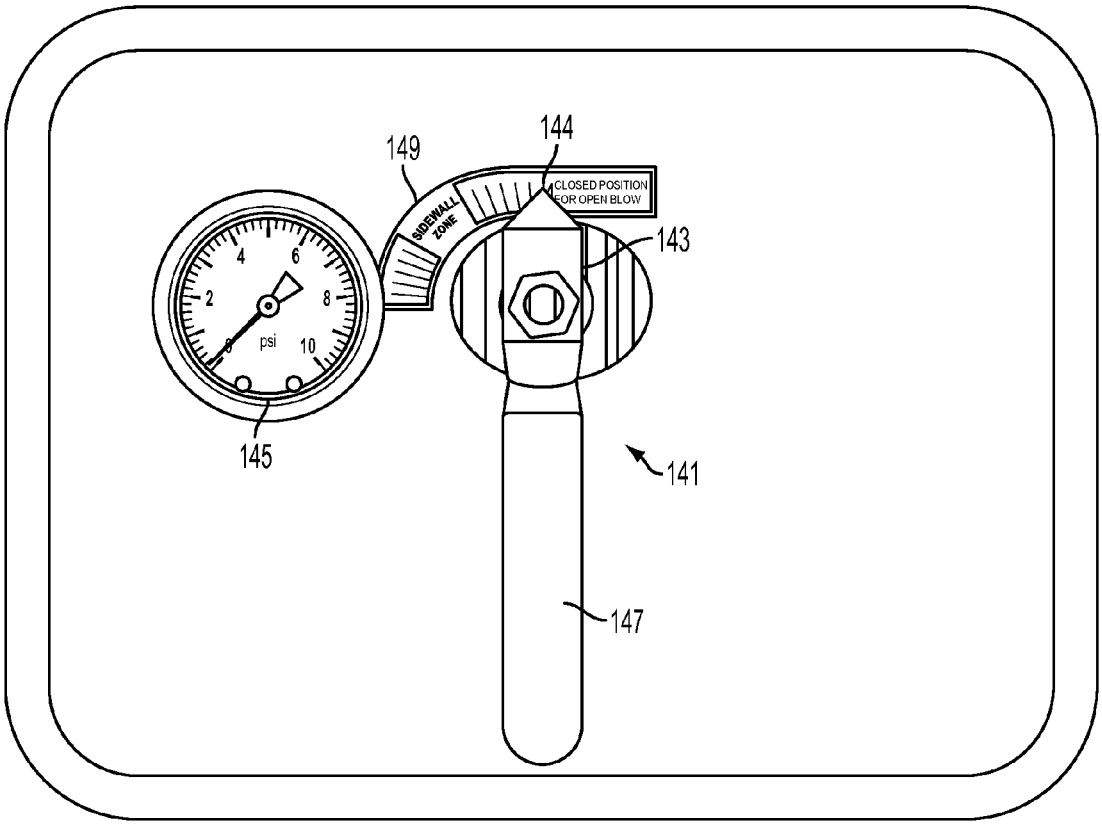

Referring now to FIGS. 10-12, an alternate embodiment of the apparatus 121 is shown. Apparatus 121 may employ any of the features, elements and components disclosed herein, and may be incorporated into the systems as described herein. Apparatus 121 further employs features that adjust the amount of material and air pressure utilized to perform some types of operations. The features allow the apparatus to adapt to different types of material applications, such as open blow attic or sidewall applications for the material.

For example, as shown in FIGS. 10 and 11, apparatus 121 has a material flow rate adjustment system 123 that is manually adjustable to vary the size of the opening between the distal end of the trough 41 and the feeder 91 or airlock. In the embodiment shown, material flow rate adjustment system 123 has a slide gate 125 that is horizontally movable (left and right in FIG. 11) within a lower channel 127. Effectively, slide gate 125 is a thin door that regulates the size of the aperture and material flow rate of material from trough 41 to feeder 91. Slide gate 125 is operated by a lever 129 that can position slide gate 125 for maximum material flow (e.g., "open blow attic" position 126). This position 126 is depicted in FIG. 11. The lever 129 may be lifted slightly and moved to the right, thereby pivoting and moving or sliding slide gate 125 to the left. These positions reduce the amount of material entering feeder 91. In the embodiment shown, there are two, lower material flow rate positions 131 and 133. In FIG. 10, lever 129 is shown in the lowest material flow rate position 133. The lever 129 and material flow rate adjustment system 123 are provided with features such as pins and detents to facilitate movement and locking of each of these positions, as is known to those of ordinary skill in the art.

As shown in FIGS. 10 and 12, apparatus 121 also may be provided with an air bleed system 141 comprising a manually-operated valve 143 and air pressure gage 145. Operation of the air bleed system 141 may be used in conjunction with the material flow rate adjustment system 123 to suitably adjust the overall operation of the apparatus for the desired application, such as open blow attic or sidewall applications.

In the embodiment of FIG. 12, the handle 147 of valve 143 is vertical and in a closed position 144 for maximum air flow pressure. This is suitable for open blow attic applications. Accordingly, the needle of gage 145 is at zero, which shows no loss or "bleed" in the air pressure from the system. The air flow pressure in the system may be reduced by intentionally losing or "bleeding" some of the air pressure. Reducing the air pressure in the system is suitable for applications such as sidewall material installations. In the illustrated embodiment, the air pressure may be reduced by rotating handle 147 counter-clockwise to partially open valve 143, such as to sidewall zone 149 (FIG. 12). Such movement of the valve will correspond in gage 145 showing the amount of air pressure that is being bled from the system.

The invention has numerous advantages. An insulation machine installation system in accordance with the invention is self-supported by its own power supply and may be mounted in a trailer or van. The design is a simple, less expensive system for installing loose fill insulation that is transported by or in a conventional trailer, truck or van.

Unlike conventional small capacity machines, the invention does not require the insulation to be broken up into smaller pieces for introduction into the feeding hopper. In contrast, this machine permits full bags to be fed, with the hopper holding a full bag plus the entry of the second bag. This is a significant advantage over small machines.

The power supply, such as a small internal combustion engine, is separated from the machine and operator area to minimize exposure of the operator to the noise, exhaust fumes and elevated temperatures originating from the power supply. The engine is located and started in one compartment, which may be baffled and ventilated, and closed with a door or hatch. Only the drive shaft of the engine extends to the machine. The operator may use a wireless radio remote to control the machine functions. This design improves work environment conditions to users operating the equipment for an extended period of time.

In some embodiments, the small to mid-size insulation machine system is designed to operate out of a mid-size van or enclosed tow utility trailer. The system has a unique design unlike any insulation system currently on the market today with its full single bag feed hopper and its stand alone power supply. Other features include taking the highly compressed fiberglass insulation and processing it with a single material dispersement mechanism. The process also efficiently feeds material into the airlock unlike conventional machines.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. The order in which activities are listed is not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. An apparatus for processing material, comprising:

a power supply; and a machine powered by the power supply and having a hopper for receiving and passing material to an auger comprising a shaft with an axis about which the auger rotates, a helical flighting mounted to the shaft, pins mounted to the helical flighting, and paddles mounted to the shaft.

2. An apparatus according to claim 1, wherein a radial outer edge of the helical flighting is crenelated with periodic notches that form rectangular blades on the helical flighting.

3. An apparatus according to claim 2, wherein the pins are rotationally and angularly aligned with leading edges of the rectangular blades.

4. An apparatus according to claim 1, wherein the pins extend radially beyond the helical flighting.

5. An apparatus according to claim 1, wherein the pins have distal ends that define a pin radial length relative to the axis, the paddles have distal ends that define a paddle radial length relative to the axis, and the pin and paddle radial lengths are substantially equal.

6. An apparatus according to claim 1, wherein an axial end of the helical flighting forms a distal edge thereof that is rotationally aligned with at least one of the paddles.

7. An apparatus according to claim 6, wherein the distal edge extends in a radially orthogonal direction relative to the axis.

8. An apparatus according to claim 6, wherein the helical flighting has an axial pitch that is cyclical and defines an axial length, and the distal edge of the helical flighting is spaced apart from said at least one of the paddles by an axial distance that is less than the axial length.

9. An apparatus according to claim 8, wherein the helical flighting has at least three axial pitches.

10. An apparatus according to claim 1, wherein each paddle comprises a plate with a surface that is flat, elongated and rectangular, each plate protrudes radially from the shaft such that the surface is parallel to the axis, and each plate is supported by a support bracket extending from the shaft.

11. An apparatus according to claim 1, wherein the paddles comprise a first set of two paddles at an axial end of the shaft that are rotationally opposed to each other relative to the axis, a second set of two paddles axially spaced apart from and rotationally orthogonal to the first set, and a single paddle axially spaced apart from and rotationally orthogonal to the second set and axially opposite the first set, and the single paddle rotationally aligns with one of the two paddles of the first set.

12. An apparatus according to claim 1, wherein the power supply is an internal combustion engine that is coupled to the machine via a drive shaft.

13. An apparatus according to claim 1, wherein the auger is located in a trough and is adapted to supply material to a feeder, and further comprising a material flow rate adjustment system that is manually adjustable to vary a size of an opening between the trough and the feeder.

14. An apparatus according to claim 13, wherein the material flow rate adjustment system has a slide gate that is horizontally movable to regulate the size of the opening and material flow rate of material from the trough to the feeder, the slide gate is operated by a manual lever having a plurality of lockable positions for different applications.

15. An apparatus according to claim 13, wherein the machine further comprises a blower that provides air pressure to the feeder and propels separated material through hoses for delivery to and installation in a building, and an air bleed system having a manually-operated valve for reducing air pressure from the blower, and an air pressure gage that depicts a loss of air pressure in response to the manually-operated valve.

16. An auger, comprising:

a shaft with an axis about which the auger rotates;

a helical flighting mounted to the shaft;

pins mounted to the helical flighting; and paddles mounted to the shaft.

17. An auger according to claim 16, wherein a radial outer edge of the helical flighting is crenelated with periodic notches that form generally rectangular blades on the helical flighting.

18. An auger according to claim 17, wherein the pins are rotationally and angularly aligned with leading edges of the generally rectangular blades.

19. An auger according to claim 16, wherein the pins extend radially beyond the helical flighting, such that a radial outer edge of the helical flighting has a shorter radial length than the pins relative to the axis.

20. An auger according to claim 16, wherein the pins have distal ends that define a pin radial length relative to the axis, the paddles have distal ends that define a paddle radial length relative to the axis, and the pin and paddle radial lengths are equal.

21. An auger according to claim 16, wherein an axial end of the helical flighting forms a distal edge thereof that is rotationally aligned with at least one of the paddles.

22. An auger according to claim 21, wherein the distal edge extends in a radially orthogonal direction relative to the axis.

23. An auger according to claim 21, wherein the helical flighting has an axial pitch that is cyclical and defines an axial length, and the distal edge of the helical flighting is spaced apart from said at least one of the paddles by an axial distance that is less than the axial length.

24. An auger according to claim 23, wherein the helical flighting has at least three axial pitches.

25. An auger according to claim 16, wherein each paddle comprises a plate with a surface that is flat, elongated and rectangular, each plate protrudes radially from the shaft such that the surface is parallel to the axis, and each plate is supported by a support bracket extending from the shaft.

26. An auger according to claim 16, wherein the paddles comprise a first set of two paddles at an axial end of the shaft that are rotationally opposed to each other relative to the axis, a second set of two paddles axially spaced apart from and rotationally orthogonal to the first set and also rotationally opposed to each other, and a single paddle axially spaced apart from and rotationally orthogonal to the second set and axially opposite the first set, and the single paddle rotationally aligns with one of the two paddles of the first set.

* * * * *